United States Patent [19]

Stamatovic

[11] 4,202,067

[45] May 13, 1980

[54] MOTORIZED WORK DEVICE WITH FLEXIBLE SHAFT

[76] Inventor: Bosko Stamatovic, 5786 - 13th Ave., Rosemount, Quebec, Canada

[21] Appl. No.: 968,962

[22] Filed: Dec. 13, 1978

[30] Foreign Application Priority Data

Oct. 30, 1978 [CA] Canada ..... 314734

[51] Int. Cl.[2] ..... A46B 13/02

[52] U.S. Cl. ..... 15/28; 51/170 T; 200/157; 200/331

[58] Field of Search ..... 15/22 R, 23, 24, 28, 15/29, 97 R, 321; 51/170 R, 170 T; 173/161, 170; 200/153 F, 161, 331; 132/73.6; 32/59

[56] References Cited

U.S. PATENT DOCUMENTS

| | | | |
|---|---|---|---|
| 2,861,578 | 11/1958 | Thompson | 132/73.6 |
| 2,944,271 | 7/1960 | Foster et al. | 15/28 |
| 3,563,252 | 2/1971 | Spohr et al. | 132/73.6 |
| 3,564,186 | 2/1971 | Mittelstadt | 200/331 |
| 3,715,770 | 2/1973 | Obregon-Gomez | 15/28 |
| 3,758,736 | 9/1973 | Tanaka | 200/157 |
| 4,131,966 | 1/1979 | Gross | 15/28 |

FOREIGN PATENT DOCUMENTS 319060 2/1920 Fed. Rep. of Germany .

*Primary Examiner*—Edward L. Roberts
*Attorney, Agent, or Firm*—McFadden, Fincham & Co.

[57] ABSTRACT

A device for providing an angularly displaceable work tool at a point removed from the power source comprising drive means, switch means associated with the drive means for actuating the drive means between ON and OFF positions, a drive shaft connected to the drive means, the drive shaft comprising a flexible rotatable member connected at one end thereof to the drive shaft, the other end of the flexible drive shaft having a work tool associated therewith, and being secured thereto, a flexible non-extensible shaft connected at one end to the switch means, and being capable of being readily actuated to actuate the switch means, both of the flexible shafts being contained in a flexible protective housing.

7 Claims, 3 Drawing Figures

MOTORIZED WORK DEVICE WITH FLEXIBLE SHAFT

This invention relates to a device for providing an angularly displaceable work tool at a point remote from a power source.

More particularly, this invention provides a device in which there is provided a work tool such as a brush, or other similar tool capable of performing work, turned by a motor located at a point remote from the work tool.

In many types of industrial applications, and even for home uses, it is desirable to have a tool which is capable of being used at a point remote from the point of the source of power for the tool. In some cases, this can be provided by merely providing a drive shaft which is driven by a motor and by mounting a tool at the remote end of the drive shaft, as, for example, in the use of a drill or the like where the shaft mounting the drill may be a relatively long shaft. In those cases, however, the shafts are invariably of a rigid nature and consequently, they are awkward to handle and have limited application.

In accordance with this invention, there is provided an improved device which is capable of having a work tool located at the end of a flexible shaft for performing work at a point remote from the motor; more particularly, this invention provides a device for mounting a device for providing an angularly displaceable work tool at a point removed from the power source comprising drive means, switch means associated with said drive means for actuating said drive means between ON and OFF positions, a drive shaft connected to said drive means, said drive shaft comprising a flexible rotatable member connected at one end thereof to said drive shaft, the other end of said flexible drive shaft having a work tool associated therewith, and being secured thereto, a flexible, non-extensible shaft connected at one end to said switch means, and being capable of being readily actuated to actuate said switch means, both of said flexible shafts being contained in a flexible protective housing.

In greater detail, the device of the present invention is adapted to be utilized as a lightweight motor driven work tool, such as a device which may be used as a polishing tool, brushing tool, screwdriver or the like, or furthermore, as a washing tool which may include a brush for the purpose of washing or scrubbing dishes, pots, pans, etc. In most instances, the drive means will comprise a motor having an output shaft which is adapted to be either battery driven or connected to a power source such as a source of electricity, to operate the motor. The power source has an integrally associated switch means for turning the motor on or off, as with conventional motors, and any suitable switch means may be utilized for this purpose.

In accordance with this invention, there is provided a flexible drive shaft connected to the drive means and this drive shaft permits the transmittal of power from the motor source to the work tool. The flexible drive shaft is of a special nature, and comprises an outer flexible housing within which there are mounted a pair of flexible shafts, one capable of transmitting a torque force to the work tool and the other comprising a flexible remote control member operatively connected to said switch means.

The outer housing of the flexible shaft may be of any suitable material which functions to provide a protective sheathing about the internal pair of shafts. As such, the material from which the outer housing is made may be varied and its particular constructions can be likewise varied depending on the type of material from which the housing is made. Typically, the outer housing may be flexible coiled metal or of plastic material such as extruded tube.

The flexible drive shaft would normally be made of a metal capable of transmitting the force exerted by the drive shaft of the motor to the work tool without breaking during usage. As such, flexible steel cable or filaments may be employed. One end of the flexible conduit or cable may be rigidly or detachably secured to the drive shaft of the motor as desired; the other end is provided with a suitable mounting means for mounting a working tool. Suitable coiled and/or other type of a string wire may be employed.

The flexible shaft connected to the on-of switch means of the motor is also operatively secured to the switch means at one end and at the other, to a remote control trigger device which is adapted to actuate the flexible shaft by movement axially of the length of the shaft.

Suitable handle means may be provided adjacent the end of the flexible shaft housing the remote control means for actuating the on-off switch and for providing a handle grip for movement of the tool.

The tool may be utilized in connection with brush means, screwdrivers or the like. A prime purpose of the device may be for use as a washing and cleaning tool employed with a brush.

Having thus generally described the invention, reference will now be made to the accompanying drawings, illustrating preferred embodiments, and in which.

Figure 1:
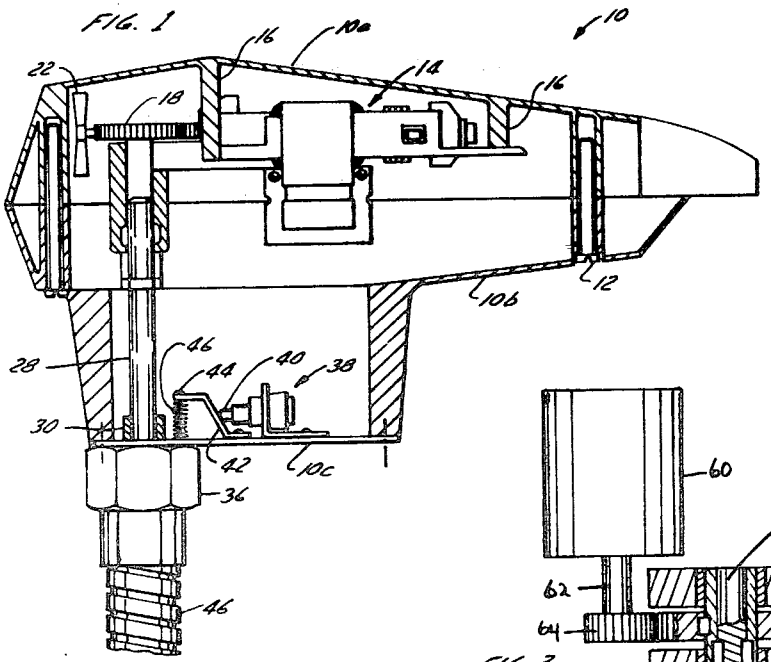
FIG. 1 is a sectional view of a portion of a device according to the present invention, showing the connection of the flexible work shaft to the motor housing.

Referring initially to FIG. 1, there is illustrated a motor used in driving the device of the present invention, which motor is housed in a housing 10 made up of two halves identified by reference numerals **10*a* and 10*b*, joined together by means of screws 12. Within the housing, a motor 14 provides the driving force for the device of the present invention, which is connected by means of suitable mountings 16 to housing 10. Motor 14 may be of any suitable type, which in this case comprises a conventional gear type motor having an output shaft (not shown) which rotates a gear 18 mounted on a shaft 20. A fan 22 is provided for the purpose of cooling the motor and is driven by the output shaft of the motor. A brushing 26 mounted on shaft 20 journals a further shaft 28 which projects through housing 10 to a further bushing 30. Shaft 28 is connected to a flexible drive shaft 34 by means of a coupling 36, which coupling 36 has a threaded outer portion fixedly securing the coupling to a mating threaded portion secured to housing 10**.

Housing 10 includes a lower portion **10*c* closing the bottom of the housing and in turn, serving as a mounting member for a switch mechanism. The switch mechanism comprises a conventional electrically operated switch 38 of a plunger type with the plunger being indicated by reference numeral 40. A Z-shaped spring member 42 is positioned in operative relationship to switch 38 with one end fixedly secured to base 10c and the other end of which mounts a movable wire cable 44 fixedly secured thereto. A coil spring 46 is journalled about wire shaft 44 between the bottom of housing 10c and the terminal portion of spring 42**.

Figure 2:
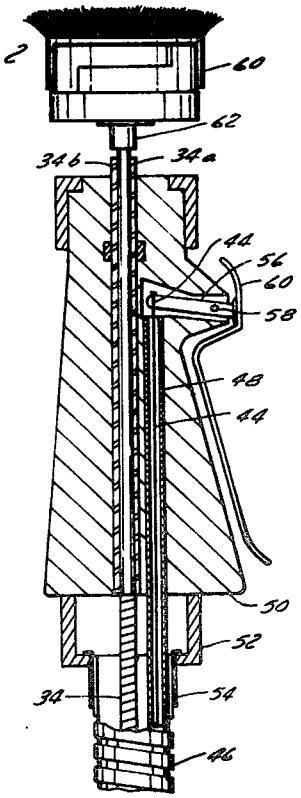
FIG. 2 is a sectional view similar to FIG. 1 showing the other portion of the device of the present invention.

Flexible drive shaft 34 and flexible wire rod 44 are enclosed within flexible shaft housing 46 extending between motor portion 10 and the work end portion illustrated in FIG. 2. This preferably is of a coiled type protective housing made of suitable metal.

In a similar manner, flexible drive shaft 34 preferably comprises a rotatable flexible steel shaft **34*a* (see FIG. 2) enclosed within an outer protective flexible metal housing 34*b*; wire rod 44 is likewise preferably enclosed within a flexible steel housing 48, with both in turn being enclosed within housing 46**.

Mounted at the distal end of the flexible protective shaft 46 is a hand grip housing 50. Housing 50 includes a hollow central core through which the shaft **34*a* and its housing 34*b* pass, as well as cable 44 and its housing 48. Flexible housing 46 terminates at the retainer ring 52 with a metal bushing 54 connecting the same to the retainer ring 52**.

Within the housing 50, there is included a pivoted lever 56 pivoting about a pin 58. Lever 56 is connected to wire cable 44 at one end, and at the other end, is connected to a finger member 60 for rotating lever 56 about the pivot point 58. In this manner, the operator of the device may actuate the electric motor by depressing the finger member 60, which in turn will cause lever 56 to pivot about its pivot point and will cause movement of flexible wire rod 44—in turn, this will urge spring 42 upwards into contact with switch 38.

Connected to the end of flexible wire shaft **34*a* is, in the example illustrated, a wire brush 60 mounted to the shaft by means of a collar 62. Collar 62 may be fixedly secured to shaft 34*a*** by means of a screw or the like.

Figure 3:
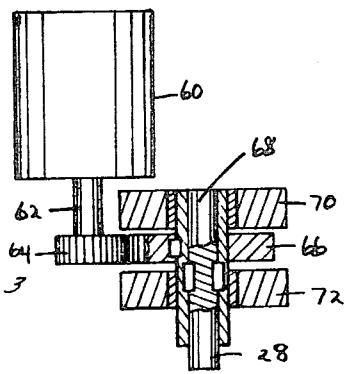
FIG. 3 illustrates a further type of drive shaft.

Referring now to FIG. 3, there is illustrated an alternative type of motor drive shaft in which a motor 60 is provided with a drive shaft 62, which in turn rotates a gear 64 meshing with a further gear 66 mounted on a shaft 68. A bushing 70 is provided on shaft 68 to journal gear 66 with a further bushing 72 being located below gear 66. Drive shaft 28 is connected to shaft 68 by means of bushings 70 and 72.

The above type of arrangement may be utilized for a simple drive arrangement for the device of the present invention.

Drive shaft 28, which is similar to drive shaft 34 of FIGS. 1 and 2 may be made of various types of material and particularly preferred for light duty use, a coiled or straight type of steel string wire such as that used for musical instruments may be utilized.

In a particularly preferred embodiment of the present invention, there is utilized a work tool such as brush 60 illustrated in FIG. 2, which may be used for domestic purposes for cleaning dishes, glasses, stoves, pots, pans, etc.

Having thus generally described the invention, it will be understood that various modifications can be made to the above-described embodiments without departing from the spirit and scope thereof. Thus, in a further embodiment of the invention, one may employ a separate motor other than that shown in the drawings. A suitable electric motor driving a shaft having a gear thereon which gear acts in cooperation with a further gear driving the shaft. Thus, the motor and main gear drive may be of any suitable type and separate components which may then be inserted in a suitable housing.

I claim:

1. A device for providing an angularly displaceable work tool at a point removed from the power source comprising drive means, switch means associated with the drive means for actuating the drive means between ON and OFF positions, a drive shaft connected to the drive means, the drive shaft comprising a flexible rotatable member connected at one end thereof to the drive means, the other end of the flexible drive shaft having a work tool associated therewith, and being secured thereto, a flexible non-extensible shaft connected at one end to the switch means, and being capable of being readily actuated to actuate the switch means, both of the flexible shafts being contained in a flexible protective housing, a housing providing a handle grip portion proximate said other end of the drive shaft, and trigger means mounted on said handle grip portion an operative relationship to said non-extensible shaft to actuate the switch means.

2. A device as defined in claim 1, wherein said flexible shafts are made of a flexible metal.

3. A device as defined in claim 1, wherein said work tool comprises a cleaning tool.

4. A device as defined in claim 1, wherein said drive means includes an electrically driven drive motor having an output shaft thereon, said output shaft rotatably driving through a gear arrangement said drive shaft.

5. A device as defined in claim 1, wherein said drive means includes a battery operated motor.

6. A device as defined in claim 1, further including means for cooling said drive means.

7. A device as defined in claim 6, wherein said cooling means comprises a fan driven by said drive means.

* * * * *